US010041212B2

(12) United States Patent
Pervan

(10) Patent No.: US 10,041,212 B2
(45) Date of Patent: Aug. 7, 2018

(54) DIGITAL OVERLAY

(71) Applicant: CERALOC INNOVATION AB, Viken (SE)

(72) Inventor: Darko Pervan, Viken (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

(21) Appl. No.: 14/155,096

(22) Filed: Jan. 14, 2014

(65) Prior Publication Data

US 2014/0220318 A1 Aug. 7, 2014

(30) Foreign Application Priority Data

Feb. 4, 2013 (SE) ..... 1350135

(51) Int. Cl.

| | |
|---|---|
| ***B05D 3/00*** | (2006.01) |
| ***B41M 3/00*** | (2006.01) |
| ***B41M 7/00*** | (2006.01) |
| ***B32B 27/14*** | (2006.01) |
| ***D06N 7/04*** | (2006.01) |
| ***D21H 27/28*** | (2006.01) |

(52) U.S. Cl.

CPC ..... *D21H 27/28* (2013.01); *Y10T 428/24893* (2015.01)

(58) Field of Classification Search

CPC ..... D21H 19/66; D21H 25/04
USPC ..... 427/198, 271
See application file for complete search history.

(56) References Cited

U.S. PATENT DOCUMENTS

| | | | | |
|---|---|---|---|---|
| 3,083,116 | A | 3/1963 | Berndt | |
| 3,397,496 | A | 8/1968 | Sohns | |
| 3,440,076 | A | 4/1969 | Vaurio | |
| 3,446,184 | A | 5/1969 | Johnson | |
| 3,545,997 | A | 12/1970 | Hochberg | |
| 3,634,975 | A * | 1/1972 | Hensley | B23D 45/027 144/363 |
| 3,648,358 | A | 3/1972 | Cannady et al. | |
| 3,880,687 | A | 4/1975 | Elmendorf et al. | |
| 4,227,200 | A | 10/1980 | Mansukhani | |
| 4,312,268 | A | 1/1982 | King et al. | |
| 4,467,007 | A * | 8/1984 | Elgie | B32B 27/12 427/203 |

(Continued)

FOREIGN PATENT DOCUMENTS

| | | |
|---|---|---|
| DE | 10 2006 057 961 A1 | 6/2008 |
| DE | 10 2007 015 907 A1 | 10/2008 |

(Continued)

OTHER PUBLICATIONS

IPCOM 000224950D, Pervan, D. et al. "Digital Printing and Embossing", Jan. 15, 2013. pp. 1-73.*

(Continued)

*Primary Examiner* — Alexander M Weddle
(74) *Attorney, Agent, or Firm* — Buchanan Ingersoll & Rooney P.C.

(57) ABSTRACT

A method to form a protective overlay with wear resistant particles applied in well-defined patterns by applying wear resistant particles on a surface, bonding a part of the wear resistant particles with a binder preferably applied with a digital drop application head and removing the non-bonded wear resistant particles from the surface.

26 Claims, 2 Drawing Sheets

(56) References Cited

U.S. PATENT DOCUMENTS 4,504,523 A * 3/1985 Miller et al. ..... 427/197
4,689,259 A 8/1987 Miller et al.
4,796,402 A * 1/1989 Pajala ..... 52/390
4,833,530 A 5/1989 Kohashi
4,880,689 A 11/1989 Park et al.
4,943,816 A 7/1990 Sporer
5,204,055 A 4/1993 Sachs
5,380,392 A * 1/1995 Imamura ..... B32B 5/32 156/257
5,498,466 A 3/1996 Navarro
5,594,484 A 1/1997 Furukawa
5,627,578 A 5/1997 Weintraub
5,718,753 A 2/1998 Suzuki et al.
5,778,789 A 7/1998 Krishnan et al.
6,387,457 B1 5/2002 Jiang et al.
6,394,595 B1 5/2002 Jiang et al.
6,402,317 B2 6/2002 Yanagawa et al.
6,422,696 B1 7/2002 Takahashi et al.
6,439,713 B1 8/2002 Noguchi et al.
6,579,616 B1 6/2003 Beckman
6,773,799 B1 8/2004 Persson et al.
7,383,768 B2 6/2008 Reichwein et al.
7,632,561 B2 12/2009 Thiers
7,908,815 B2 3/2011 Pervan
8,114,513 B2 2/2012 Rentschler
8,337,947 B2 12/2012 Camorani
8,353,140 B2 1/2013 Pervan
8,371,456 B2 2/2013 Scadden
8,464,489 B2 6/2013 Pervan
8,544,230 B2 10/2013 Pervan
9,079,212 B2 7/2015 Pervan et al.
9,279,058 B2 3/2016 Pervan et al.
9,321,925 B2 4/2016 Pervan et al.
9,371,456 B2 6/2016 Pervan et al.
9,446,602 B2 9/2016 Pervan
9,528,011 B2 12/2016 Pervan et al.
9,630,404 B2 4/2017 Pervan et al.
9,670,371 B2 6/2017 Pervan et al.
9,738,095 B2 8/2017 Pervan et al.
9,873,803 B2 1/2018 Pervan et al.
2001/0005542 A1 6/2001 Graab et al.
2001/0022607 A1 9/2001 Takahashi et al.
2002/0149137 A1 10/2002 Jang et al.
2003/0108718 A1 6/2003 Simon et al.
2003/0138618 A1 7/2003 Courtoy
2003/0173695 A1 9/2003 Monkhouse
2003/0207083 A1 11/2003 Hansson
2004/0101619 A1 5/2004 Camorani
2004/0142107 A1 7/2004 Eriksson et al.
2004/0153204 A1 8/2004 Blanco
2004/0177788 A1 9/2004 Rick et al.
2004/0180181 A1 9/2004 Franzoi et al.
2004/0180980 A1 9/2004 Petter et al.
2004/0217186 A1 11/2004 Sachs
2005/0093194 A1 5/2005 Oriakhi
2005/0128274 A1 6/2005 Matsushima
2005/0176321 A1 8/2005 Crette et al.
2005/0249923 A1 11/2005 Reichwein et al.
2006/0144004 A1 7/2006 Nollet
2006/0188670 A1 8/2006 Kojima
2006/0246266 A1* 11/2006 Hall ..... 428/195.1
2007/0049047 A1 3/2007 Fujimoto
2007/0091160 A1 4/2007 Kis
2007/0107344 A1 5/2007 Kornfalt
2007/0193174 A1 8/2007 Vogel et al.
2007/0224438 A1 9/2007 Van Benthem et al.
2007/0240585 A1 10/2007 Vaish et al.
2007/0283648 A1 12/2007 Chen
2007/0299196 A1 12/2007 Ohkoshi et al.
2008/0010924 A1 1/2008 Pietruczynik et al.
2008/0098659 A1* 5/2008 Sung ..... B24D 18/0072 51/293
2008/0185092 A1 8/2008 Blenkhorn
2008/0241472 A1 10/2008 Shiao et al.
2008/0261003 A1 10/2008 Lewis et al.
2009/0010682 A1 1/2009 Camorani
2009/0031662 A1 2/2009 Chen et al.
2009/0047480 A1 2/2009 Juers et al.
2009/0116966 A1 5/2009 Althoff et al.
2009/0151866 A1 6/2009 Endert
2009/0155612 A1 6/2009 Pervan et al.
2009/0252925 A1 10/2009 Provoost
2010/0046010 A1 2/2010 Bauer
2010/0134895 A1 6/2010 Hoffman et al.
2010/0166997 A1 7/2010 Chisaka et al.
2010/0192793 A1 8/2010 Verhaeghe
2010/0196678 A1 8/2010 Vermeulen
2010/0300020 A1 12/2010 Vermeulen
2010/0300030 A1 12/2010 Pervan et al.
2010/0307677 A1* 12/2010 Buhlmann ..... B32B 21/02 156/277
2011/0024938 A1 2/2011 Tripp et al.
2011/0038826 A1 2/2011 Kimball et al.
2011/0129640 A1 6/2011 Beall
2011/0171412 A1 7/2011 Döhring
2011/0177354 A1 7/2011 Ziegler
2011/0189448 A1 8/2011 Lindgren et al.
2011/0189471 A1* 8/2011 Ziegler et al. ..... 428/323
2011/0237739 A1 9/2011 Tada
2011/0247748 A1* 10/2011 Pervan ..... B44C 5/0476 156/220
2011/0250404 A1 10/2011 Pervan et al.
2011/0261464 A1 10/2011 Hoffmann et al.
2011/0268937 A1 11/2011 Schacht et al.
2011/0293906 A1* 12/2011 Jacobsson ..... B05D 5/06 428/206
2012/0176443 A1 7/2012 Robertson et al.
2012/0196081 A1 8/2012 Gleich
2012/0263878 A1 10/2012 Ziegler et al.
2012/0264853 A1 10/2012 Ziegler et al.
2012/0269983 A1 10/2012 Grinberg
2013/0043211 A1 2/2013 Vermeulen
2013/0108873 A1 5/2013 Shiao et al.
2014/0017452 A1 1/2014 Pervan et al.
2014/0023832 A1 1/2014 Pervan et al.
2014/0028772 A1 1/2014 Pervan
2014/0196618 A1 7/2014 Pervan et al.
2014/0198168 A1 7/2014 Pervan et al.
2014/0198170 A1 7/2014 Pervan et al.
2014/0199495 A1 7/2014 Pervan et al.
2014/0199513 A1 7/2014 Pervan et al.
2014/0199531 A1 7/2014 Pervan et al.
2015/0030817 A1 1/2015 Wiegelmann
2015/0274997 A1 10/2015 Pervan et al.
2015/0298492 A1 10/2015 Palumbo
2016/0144612 A1 5/2016 Pervan et al.
2016/0208116 A1 7/2016 Pervan et al.
2016/0250853 A1 9/2016 Pervan et al.
2016/0325559 A1 11/2016 Pervan et al.
2016/0368280 A1 12/2016 Pervan
2017/0066255 A1 3/2017 Pervan
2017/0204281 A1 7/2017 Pervan et al.
2017/0232761 A1 8/2017 Pervan et al.
2017/0348984 A1 12/2017 Pervan et al.

FOREIGN PATENT DOCUMENTS

DE 10 2010 036 454 A1 1/2012
EP 0 403 264 A2 12/1990
EP 0 657 309 A1 6/1995
EP 0 769 535 A2 4/1997
EP 0 769 535 A3 9/1997
EP 1 020 303 A1 7/2000
EP 1 020 765 A1 7/2000
EP 1 209 199 A1 5/2002
EP 1 460 108 A1 9/2004
EP 1 584 378 A1 10/2005
EP 1 961 556 A1 8/2008
EP 2 106 903 A1 10/2009
EP 2 108 524 A1 10/2009
EP 2 213 476 A1 8/2010
EP 2 363 299 A1 9/2011
EP 2363299 A1 * 9/2011
EP 1 460 108 B1 10/2012

(56) References Cited

FOREIGN PATENT DOCUMENTS

| | | | |
|---|---|---|---|
| GB | 1 215 551 | A | 12/1970 |
| GB | 1 344 197 | A | 1/1974 |
| GB | 2 065 556 | A | 7/1981 |
| GB | 2 128 898 | A | 5/1984 |
| GB | 2 419 110 | A | 4/2006 |
| GB | 2 452 545 | A | 3/2009 |
| JP | S51-128409 | A | 11/1976 |
| JP | H05-320541 | A | 12/1993 |
| JP | H06-183128 | A | 7/1994 |
| JP | 6-287467 | A | 10/1994 |
| JP | H10-095165 | A | 4/1998 |
| JP | 2000-158796 | A | 6/2000 |
| JP | 2001-311254 | A | 11/2001 |
| JP | 2005-097339 | A | 4/2005 |
| JP | 2006-036559 | A | 2/2006 |
| JP | 2006-167651 | A | 6/2006 |
| JP | 2008-156573 | A | 7/2008 |
| JP | 2008-265229 | A | 11/2008 |
| JP | 2009-173003 | A | 8/2009 |
| JP | 2010-209325 | A | 9/2010 |
| JP | 2011-522138 | A | 7/2011 |
| JP | 2001-311254 | A | 11/2011 |
| KR | 2009-0112326 | A | 10/2009 |
| WO | WO 01/72489 | A2 | 10/2001 |
| WO | WO 02/42373 | A1 | 5/2002 |
| WO | WO 03/057488 | A1 | 7/2003 |
| WO | WO 2005/097874 | A2 | 10/2005 |
| WO | WO 2005/120847 | A1 | 12/2005 |
| WO | WO 2006/057241 | A1 | 6/2006 |
| WO | WO 2006/125036 | A2 | 11/2006 |
| WO | WO 2007/033031 | A2 | 3/2007 |
| WO | WO 2007/060298 | A1 | 5/2007 |
| WO | WO 2007/096746 | A2 | 8/2007 |
| WO | WO 2007/109763 | A2 | 9/2007 |
| WO | WO 2007/109763 | A3 | 9/2007 |
| WO | WO 2007/125098 | A1 | 11/2007 |
| WO | WO 2008/042088 | A1 | 4/2008 |
| WO | WO 2008/067933 | A1 | 6/2008 |
| WO | WO 2008/121749 | A1 | 10/2008 |
| WO | WO 2009/030935 | A2 | 3/2009 |
| WO | WO 2009/065769 | A2 | 5/2009 |
| WO | WO 2009/065769 | A3 | 5/2009 |
| WO | WO 2009/080772 | A1 | 7/2009 |
| WO | WO 2010/070485 | A2 | 6/2010 |
| WO | WO 2011/064075 | A2 | 6/2011 |
| WO | WO 2011/077200 | A1 | 6/2011 |
| WO | WO 2011/107610 | A1 | 9/2011 |
| WO | WO 2011/129757 | A1 | 10/2011 |
| WO | WO 2012/007230 | A1 | 1/2012 |
| WO | WO 2012/141651 | A1 | 10/2012 |
| WO | WO 2014/014400 | A1 | 1/2014 |
| WO | WO 2014/017972 | A1 | 1/2014 |
| WO | WO 2014/037823 | A1 | 3/2014 |
| WO | WO 2014/109703 | A1 | 7/2014 |

OTHER PUBLICATIONS

International Search Report issued in PCT/SE2014/050141, dated Apr. 29, 2014, Patent-och registreringsverket, Stockholm, SE, 6 pages.

Pervan, Darko, Technical Disclosure entitled "Digital Overlay," IP.com No. IPCOM000225271D, IP.com PriorArtDatabase, Feb. 5, 2013, 24 pages.

U.S. Appl. No. 14/152,253, Pervan, et al.

U.S. Appl. No. 14/152,347, Pervan, et al.

U.S. Appl. No. 14/152,281, Pervan, et al.

U.S. Appl. No. 14/152,393, Pervan, et al.

U.S. Appl. No. 14/152,356, Pervan, et al.

U.S. Appl. No. 14/152,295, Pervan, et al.

Pervan, Darko, et al., Technical Disclosure entitled Digital Printing and Embossing, IP.com No. IPCOM000224950D, IP.com PriorArtDatabase, Jan. 15, 2013, 89 pages.

Odian, George, "Principles of Polymerization," 1991, 3rd Edition, 5 pages incl. pp. 122-123, John Wiley & Sons, Inc., New York, NY, USA.

Pervan, Darko, et al., U.S. Appl. No. 14/152,253, entitled "Digital Binder and Powder Print," filed in the U.S. Patent and Trademark Office on Jan. 10, 2014.

Pervan, Darko, et al., U.S. Appl. No. 14/152,347, entitled "Dry Ink for Digital Printing," filed in the U.S. Patent and Trademark Office on Jan. 10, 2014.

Pervan, Darko, et al., U.S. Appl. No. 14/152,281, entitled "Digital Embossing," filed in the U.S. Patent and Trademark Office on Jan. 10, 2014.

Pervan, Darko, et al., U.S. Appl. No. 14/152,393, entitled "Digital Printing with Transparent Blank Ink," filed in the U.S. Patent and Trademark Office on Jan. 10, 2014.

Pervan, Darko, et al., U.S. Appl. No. 14/152,356, entitled "Digital Thermal Binder and Powder Printing," filed in the U.S. Patent and Trademark Office on Jan. 10, 2014.

Pervan, Darko, et al., U.S. Appl. No. 14/152,295, entitled "Digital Printing and Embossing," filed in the U.S. Patent and Trademark Office on Jan. 10, 2014.

U.S. Appl. No. 14/739,307, Pervan, et al.

Pervan, Darko, et al., U.S. Appl. No. 14/739,307 entitled "Dry Ink for Digital Printing", filed in the U.S. Patent and Trademark Office on Jun. 15, 2015.

Hudd, "Chapter 1: Inkjet Printing Technologies," *Chemistry of Inkjet Inks*, 2010, pp. 3-18, World Scientific Publishing Co. PTE. Ltd. , Published in Singapore and Hackensack, NJ.

Owens, James C., "A Tutorial on Printing", Imaging.org-Resources, 2010, pp. 1-5, Society for Imaging sciences and Technology, retrieved Jul. 27, 2015 from http://web.archive.org/web/20100706153535/http://www.imaging.org/ist/resources/tutorial.

"Digital," Definition by Merriam-Webster, 2015, pp. 1-5, Merriam-Webster, Incorporated, retrieved Aug. 6, 2015 from http://www.merriam-webster.com/dictionary/digital.

U.S. Appl. No. 15/081,120, Pervan, et al.

Pervan, Darko, et al., U.S. Appl. No. 15/081,120 entitled "Dry Ink for Digital Printing," filed in the U.S. Patent and Trademark office on Mar. 25, 2016.

U.S. Appl. No. 15/013,310, Pervan, et al.

Pervan, Darko, et al., U.S. Appl. No. 15/013,310 entitled "Digital Embossing," filed in the U.S. Patent and Trademark Office on Feb. 2, 2016.

U.S. Appl. No. 15/216,081, Pervan, et al.

U.S. Appl. No. 15/251,330, Pervan.

Pervan, Darko, et al., U.S. Appl. No. 15/216,081 entitled "Digital Embossed in Register Surface," filed in the U.S. Patent and Trademark Office on Jul. 21, 2016.

Pervan, Darko, U.S. Appl. No. 15/251,330 entitled "Digital Binder Printing," filed in the U.S. Patent and Trademark Office on Aug. 30, 2016.

U.S. Appl. No. 15/354,338, Pervan.

Pervan, Darko, U.S. Appl. No. 15/354,338 entitled "Digital Binder and Powder Print," filed in the U.S. Patent and Trademark Office on Nov. 17, 2016.

U.S. Appl. No. 15/150,571, Pervan, et al.

Pervan, Darko, et al., U.S. Appl. No. 15/150,571 entitled "Digital Thermal Binder and Powder Printing," filed in the U.S. Patent and Trademark Office on May 10, 2016.

U.S. Appl. No. 15/478,581, Pervan et al.

U.S. Appl. No. 15/585,482, Pervan et al.

Pervan, Darko, et al., U.S. Appl. No. 15/478,581 entitled "Dry Ink for Digital Printing," filed in the U.S. Patent and Trademark Office on Apr. 4, 2017.

Pervan, Darko, et al., U.S. Appl. No. 15/585,482 entitled "Digital Thermal Binder and Powder Printing," filed in the U.S. Patent and Trademark office on May 3, 2017.

Extended European Search Report dated Aug. 16, 2016 in EP 14 74 6498.6, European Patent Office, Munich, DE, 7 pages.

Romano, Frank J., Digital Printing Pocket Primer Series "Mastering On-Demand and Variable Data Printing for Profit," Copyright 2000, 52 pages, Windsor Professional Information, L.L.C., San Diego, CA.

(56) References Cited

OTHER PUBLICATIONS

Sandpaper Definition, Wikipedia, the free encyclopedia, retrieved from the Internet: https://en.wikipedia.org/wiki/Sandpaper, Jan. 24, 2017, 8 pages.
Pervan, Darko, et al., U.S. Appl. No. 15/840,056 entitled "Digital Thermal Binder and Powder Printing," filed in the U.S. Patent and Trademark Office on Dec. 13, 2017.
Pervan, Darko, et al., U.S. Appl. No. 15/845,828 entitled "Dry Ink for Digital Printing", filed in the U.S. Patent and Trademark Office on Dec. 18, 2017.
Pervan, Darko, U.S. Appl. No. 15/903,444 entitled "Digital Binder Printing," filed in the U.S. Patent and Trademark Office on Feb. 23, 2018.

* cited by examiner

DIGITAL OVERLAY

CROSS REFERENCE TO RELATED APPLICATIONS

The present application claims the benefit of Swedish Application No. SE 1350135-8, filed on Feb. 4, 2013. The entire contents of Swedish Application No. SE 1350135-8 are hereby incorporated herein by reference in their entirety.

TECHNICAL FIELD

The disclosure relates to the field of digitally created wear resistant surfaces for building panels such as floor and furniture components. The disclosure relates to hard wear resistant particles that are positioned in pre-determined patterns on a surface.

FIELD OF APPLICATION

Embodiments of the present disclosure are particularly suitable for use in floors, which are formed of floor panels comprising a core, a decorative layer and a transparent wear resistant protective layer above the decorative layer. Preferred embodiments are conventional laminate floors, powder based floor, wood floors, plastic based LVT floors and ceramic tiles. The following description of techniques, problems of known technology and objects and features of the disclosure will therefore, as a non-restrictive example, be aimed above all at this field of application and in particular at floorings which are similar to conventional laminated floorings. The embodiments of the disclosure may also be used to produce wear resistant surfaces on any essentially flat panels preferably furniture components.

BACKGROUND

The following description is used to describe the background and products, materials and production methods that may comprise specific parts of preferred embodiments in the disclosure of this disclosure.

The majority of all laminate floors are produced according to a production method generally referred to as Direct Pressed Laminate (DPL). Such laminated floors have a core of 6-12 mm fibreboard, a 0.2 mm thick upper decorative surface layer of laminate and a 0.1-0.2 mm thick lower balancing layer.

The surface layer of a laminate floor is characterized in that the decorative and wear properties are generally obtained with two separate layers of paper, one above the other. The decorative layer is generally a melamine formaldehyde (hereafter shortened to melamine) impregnated printed paper and the wear layer is a melamine impregnated transparent overlay paper, which comprises small wear resistant aluminium oxide particles such as corundum, hereafter shortened to aluminium oxide.

The overlay paper is made of pure cellulose, which is based on delignified pulp. The overlay paper becomes almost completely transparent after lamination and the appearance of the decor paper is visible. Thicker overlay papers with a considerable amount of aluminium oxide particles may give a high wear resistance. The disadvantage is that they are less transparent and a grey layer that disturbs the printed pattern covers the decorative pattern.

The wear resistant aluminium oxide particles may be included in an overlay paper in several ways during impregnation. They may be mixed into the liquid melamine resin or scattered on the wet overlay paper. Paper based overlay may be replaced with a liquid overlay comprising a mix of aluminium oxide particles and liquid melamine resin that is applied on the impregnated décor paper.

The printed decorative paper and the overlay are laminated to a HDF core in large discontinuous or continuous laminate presses where the resin cures under high heat (about 170° C.) and pressure (40-60 bars) and the papers are laminated to the core material. An embossed press plate or steal belt forms the surface structure. Sometimes a structured paper is used as a press matrix. The embossing is in high quality floors made in register with the design.

Laminated floors may also be produced with direct printing technology. Hydro printing inks are used to print the décor by a multicolour printing press. The print is covered with a protective transparent wear layer that may be an overlay, a plastic foil or a lacquer that may comprise wear resistant particles.

Direct printing technology may be replaced with digital printing technology that is much more flexible and small production volumes can be economically manufactured. The difference between these two methods is mainly the printing step where the printing rollers are replaced by a digital non-contact printing process.

Recently new "paper free" floor types have been developed with solid surfaces comprising a substantially homogenous powder mix of fibres, binders and wear resistant particles hereafter referred to as WFF (Wood Fibre Floor).

The powder mix may comprise aluminium oxide particles, melamine resins and wood fibres. In most applications colour pigments are included in the mix and all these materials are applied in dry form as a mixed powder on a HDF core and cured under heat and pressure to a 0.1-1.0 mm solid layer.

Several advantages over known technology and especially over conventional laminate floorings may be obtained such as increased wear and impact resistance, deep embossing, increased production flexibility and lower costs. Digital powder printing has been developed and it is possible to create very advanced designs by injecting ink into the powder prior to pressing. The powder layer may include one or several powder based base colours and digital ink jet printing may only produce a small part of the total décor. A powder overlay comprising a mix of transparent fibres, wear resistant particles and melamine powder may be used to increase the wear resistance of the digital print. Such protective layer is applied even on the base layer where it is not needed since abase layer comprising wear resistant particles have sufficient wear resistance.

Wood floors are delivered as pre finished floors with a wood surface that is coated with several transparent layers in the factory. The coating may be made with UV cured polyurethane that comprises wear restante particles.

Ceramic tiles are one of the major materials used for flooring and wall coverings. A tile body comprising clay minerals is covered with one or several layers of glaze that may comprise wear resistant particles.

Luxury Vinyl Tiles, generally referred to as LVT floorings, are constructed as a layered product. The base layer is made primarily of PVC mixed with chalk filler in order to reduce material costs. The base layer has a high quality printed decorative PVC foil on the upper side. A transparent wear layer of vinyl with a thickness of 0.2-0.6 mm is generally applied on the decorative foil. The transparent layer may include a coating of polyurethane, which provides additional wear and stain resistance. Such polyurethane layer may comprise wear resistant particles.

As a summary it may be mentioned that wear resistant particles, especially aluminium oxide, are used in many floor types in order to increase the wear resistance of the floor surface.

Definition of Some Terms

In the following text, the visible surface of the installed floor panel is called "front side", while the opposite side of the floor panel, facing the sub floor, is called "rear side".

By "up" is meant towards the front side and by "down" towards the rear side. By "vertically" is meant perpendicular to the surface and by "horizontally" parallel to the surface.

By "binder" is meant a substance that connects or contributes to connect two particles or materials. A binder may be liquid, powder based, a thermosetting or thermoplastic resin and similar. A binder may consist of two components that react when in contact with each other.

By "digital printing" is meant a digitally controlled ejection of drops of fluid comprising a colorant from a print head onto a surface.

By "panel" is meant a sheet shaped material with a length and width that is larger than the thickness. This rather broad definition covers, for example, laminate and wood floors, tiles, LVT, sheet shaped wall coverings and furniture components.

KNOWN TECHNIQUE AND PROBLEMS THEREOF

The general technologies, which are used by the flooring industry to provide a wear resistant surface, are mainly based on applying wear resistant particles such as aluminium oxide on an upper part of the floor surface. The particles are applied at random. Due to production tolerances, some parts of the surface may comprise larger amounts than other part and the average amount is generally higher than needed. Clusters of particles may create grey spots and unwanted shadings. Laminate floors are produced as large sheets that are cut into several panels. Wear resistant particles are applied over the whole sheet and even on areas where the saw blade cuts the sheet into individual panels and where parts of the surface is removed when the locking systems are formed. This creates high wear on the saw blades and on the milling tools. The surface is generally embossed with low and high portions. The wear on the high portions is much higher that on the low portions.

Powder based digitally printed floors may comprise much more wear resistant particles than necessary if they are covered by a powder overlay that covers even the unprinted parts where no protective layer is needed.

It would be a major advantage if the wear resistant particles may be applied in a more precise way and especially if they may be applied in well-defined pre-determined patterns that may cover parts of the floor surface.

It is known from pre-published material (IP.COM 000224950D, the entire contents of which are hereby incorporated herein by reference in their entirety) and from the web site of Välinge innovation AB that particles may be applied in well-defined patterns with a combination of blank and dry ink. A cost efficient method to apply wear resistant particles on specific surface portions is not described.

OBJECTS AND SUMMARY

The main objective of certain embodiments of the disclosure is to provide an improved and cost efficient wear resistant protective layer comprising wear resistant particles.

Embodiments of the disclosure is based on a main principle where application of the wear resistant particles is divided in two separate steps. The particles are applied on a surface. Some particles are bonded by a preferably digitally formed pattern. Other non-bonded particles are removed and the remaining bonded particles form a pre-determined pattern of wear resistant particles. This two-step process may be repeated and several layers of wear and scratch resistant particles may be applied such that an advanced wear resistant layer with particles spaced from each other with pre-determined distances may be formed.

The major advantages compared to conventional random applications are that application of the wear resistant particles may be made in a controlled and very precise way. Contrary to known technology wear resistant particles may be evenly distributed and applied in precise digitally formed raster patterns and only on surface portions where they are needed and in amounts that are adapted to the wear properties of the underlying surface portions and to the wear intensity that surface portions are exposed to, for example, edge portions and upper portions of embossed surfaces where the wear is considerably higher than in other parts of the floor. Embodiments of the disclosure may provide wear resistant surfaces with surface portions comprising variations in wear properties, scratch resistant properties and gloss levels. Surface portion that are cut and milled may be formed without wear resistant particles in order to reduce tool wear.

A first aspect of the disclosure is a method of forming a digital pattern of wear resistant particles on a sheet comprising a surface wherein the method comprises the steps of:

applying a liquid binder in a pattern on the surface;

applying wear resistant particles on the surface;

bonding a part of the wear resistant particles to the surface with the liquid binder; and removing non-bonded wear resistant particles from the surface such that a digital pattern is formed by the bonded wear resistant particles.

The wear resistant particles may be applied in a raster pattern with pre-determined distance between the wear resistant particles.

The pre-determined distance may essentially correspond to surface portions where the sheet is to be cut into several panels and/or where locking systems will be formed.

The surface may comprises a printed décor and the wear resistant particles are spaced from each other and coordinated in register with the printed décor.

The surface may comprise a printed and embossed décor with upper and lower surface portions and wherein the content of wear resistant particles are higher in the upper portions than in the lower portions.

The wear resistant particles may comprise aluminium oxide such as corundum.

The wear resistant particles may be coated or mixed with a thermosetting resin.

The surface may be a powder layer, a paper layer or a foil.

The surface may be a part of a floor panel.

The wear resistant particles may be removed by an airstream.

The binder may be blank ink comprising a liquid substance that is applied by a digital drop application head.

The liquid substance may be water based.

The liquid substance may be exposed to IR light or hot air.

The liquid substance may be applied with a Piezo ink head.

The liquid substance may be applied with a thermo ink head.

The surface with the wear resistant particles may be heated and pressed.

The wear resistant particles may be applied by scattering.

The wear resistant particles may be arranged in a wood grain or a stone pattern.

A second aspect of the disclosure is a panel with a decorative surface comprising a pattern of wear resistant particles wherein the wear resistant particles are applied in a raster pattern with pre-determined distance between the wear resistant particles.

The surface may comprise a printed décor and the wear resistant particles are spaced from each other and coordinated with the printed décor.

The surface may comprise a printed and embossed décor with an upper and a lower surface portion and wherein the content of wear resistant particles are higher in the upper surface portion than in the lower surface portion.

An edge portion may comprise a higher content of wear resistant particles than an inner surface portion spaced from the edge portion.

The surface may be a paper layer or a foil.

The surface may comprise a powder layer.

The surface may be a part of a building panel.

The surface may be a part of a floor panel.

The wear resistant particles may comprise aluminium oxide such as corundum.

The wear resistant particles may be arranged in a wood grain or a stone pattern.

The surface may be a part of a panel that is a laminate or wood floor, a powder based floor, a tile or a LVT floor.

A third aspect of the disclosure is a sheet with a decorative surface comprising a pattern of wear resistant particles wherein the wear resistant particles are applied in a raster pattern with pre-determined distance between the wear resistant particles.

The pre-determined distance may essentially correspond to surface portions where the sheet is to be cut into several panels and/or where locking systems will be formed.

The surface may comprise a printed décor and the wear resistant particles are spaced from each other and coordinated in register with the printed décor.

The surface may comprise a printed and embossed décor with upper and lower surface portions and wherein the content of wear resistant particles are higher in the upper portions than in the lower portions.

The wear resistant particles may comprise aluminium oxide such as corundum.

A fourth aspect of the disclosure is a paper comprising a pattern of wear resistant particles wherein the wear resistant particles are applied in a raster pattern with pre-determined distance between the wear resistant particles.

BRIEF DESCRIPTION OF THE DRAWINGS

The disclosure will in the following be described in connection to preferred embodiments and in greater detail with reference to the appended exemplary drawings, wherein, FIGS. 1*a-e* Illustrate surfaces comprising wear resistant particles.

DETAILED DESCRIPTION OF EMBODIMENTS

Figure 1A:
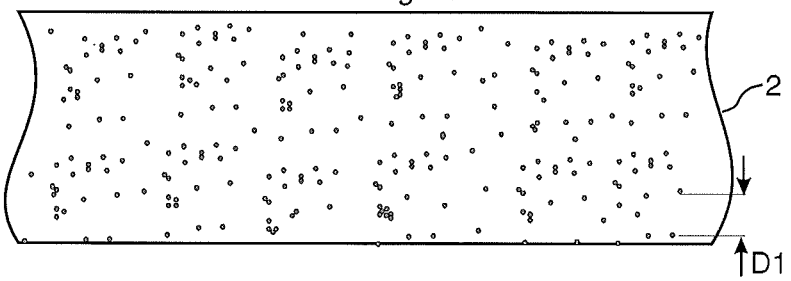

FIG. 1*a* shows a conventional application of aluminium oxide particles on a paper based overlay surface 2 used in laminate floorings. The particles, which have a size of about 0.1 mm are applied at random and the whole surface, is covered. Some surface portions comprise larger amounts and some smaller amounts. Two to five particles and even more may be connected to each in clusters and some particles may be spaced from each other with a distance D1 of up to about 1 mm.

Figure 1B:
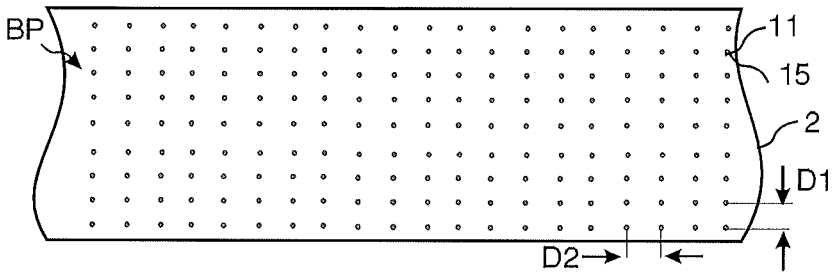

FIG. 1*b* shows schematically an embodiment of the disclosure, which is based on a preferred principle where a binder pattern BP is formed digitally by an ink head, hereafter referred to as digital drop application head, that preferably only applies a binder 11, hereafter referred to as blank ink, on a surface 2. Wear resistant particles hereafter referred to as dry overlay 15 that comprises, for example, small aluminium oxide particles, are applied such that they are in contact with the binder pattern BP. The blank ink 11 connects some particles that form the same pattern as the binder 11 and a pattern BP of wear resistant particles is formed on the surface 2 when other non-bonded particles 15 are removed from the surface 2 by, for example, vacuum. This method allows that the surface 2 may be covered with wear resistant dry overlay comprising particles that are evenly distributed on the surface with pre-defined distances D1, D2 between the major parts of the particles. An ideal distance between the particles is about 0.2-0.6 mm and no clusters of connected particles should occur. Such evenly distributed particles of dry overlay provide a high quality surface with high wear resistance and transparency combined with low material costs.

The blank ink 11 and the dry overlay 15 may be applied in many alternative ways. The blank ink may be applied on the dry overlay or the dry overlay may be applied on the blank ink. The surface may point upwards or downwards and the blank and/or the dry overlay particles may be applied from above or from below. A surface with blank ink may, for example, point downwards and may be brought into contact with a dry overlay layer. Non-bonded dry overlay particles may be removed by gravity when the surface is separated from the dry overlay layer. In order to simplify the description, the majority of the preferred embodiments show a surface pointing upwards.

Figure 1C:
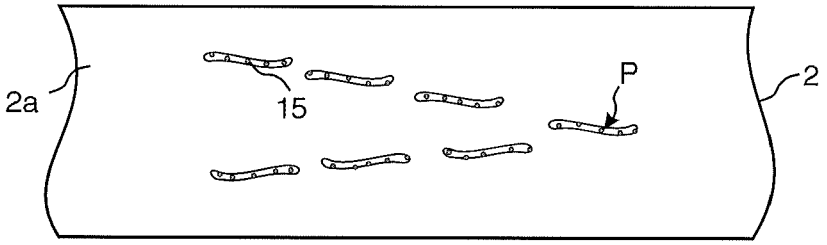

FIG. 1*c* shows a powder-based surface 2 comprising a base colour 2*a* and a digital print P applied on the base colour. The base colour may comprise wear resistant particles and a second layer of dry overlay particles 15 is only applied on the printed parts P. The application is made in two steps as described above with blank ink and dry overlay where the dry overlay applied on the non printed portions is removed.

Figure 1D:
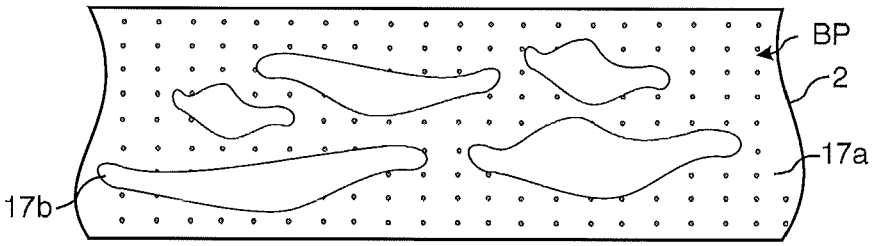

FIG. 1*d* shows a surface 2 with embossed upper 17*a* and lower 17*b* surface portions. The wear resistant particles are preferably only applied on the upper portions 17*a*, which are exposed to high wear. Surface portions may also be formed with different amounts of particles per cm2. The amount of particles may, for example, be larger in the lower portions than in the upper portions.

Figure 1E:
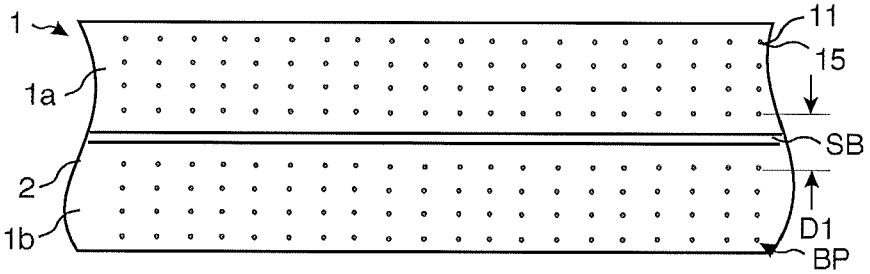

FIG. 1*e* shows a sheet 1 which is after pressing divided into two floor panels 1*a*, 1*b*. The wear resistant particles are applied with a distance D1 that corresponds to the part of the surface that is removed when the sheet 1 is cut and the locking systems are formed on the individual panels 1*a*, 1*b*. The distance D1 is preferably larger than a few mm, which corresponds to the width of a saw blade SB. The distance may also be about 5-10 mm, which corresponds to the surface portion that is needed to form the major part of the mechanical locking system.

A protective layer of, for example, bleached fibres and melamine resin or only melamine or only fibres may be applied on the wear resistant particles in order to, for example, protect press plates during pressing or to create different gloss levels.

Figure 2A:
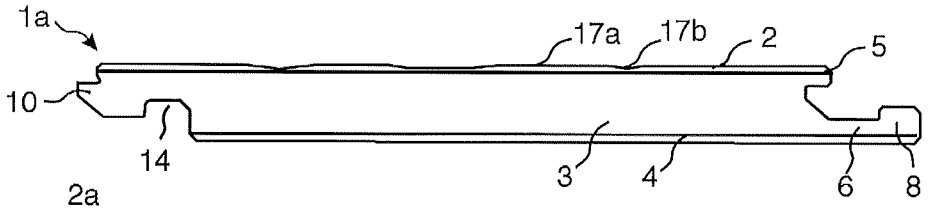
FIGS. 2*a-b* Illustrate a sheet and a floor panel having a surface with wear resistant particles.
Figure 2B:
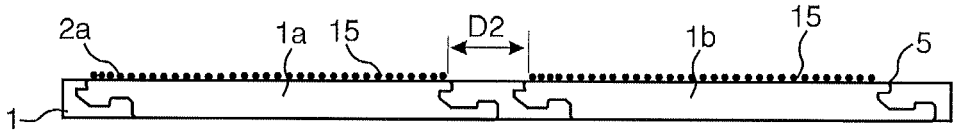

FIG. 2*a* shows a panel 1*a* with a core 3, a balancing layer 4 and an embossed surface 2 comprising upper 17*a* and lower parts 17*b*. The panel edges are formed with a mechanical locking system comprising a strip 6, with a locking element 8 in one edge that cooperates with a locking groove 14 in an adjacent edge of another panel for horizontal locking of the adjacent edges and a tongue 10 in one edge that cooperates with a tongue groove 9 in another edge for vertical locking of the panels. The panel comprises bevels 5 at the upper edges. The panel may comprise different amounts of dry overlay on the upper and lower surface portions FIG. 2*b* shows a sheet 1 which is cut into two individual panels 1*a* and 1*b*. The wear resistant particles are applied in patterns with a distance D2 between the particles such that the wear properties of surface portions, which are removed in connection with cutting, and milling of the locking systems and the bevels are lower in such portions than in other parts of the sheet. Preferably such portions should be produced such that the content of wear resistant particles is as small as possible, preferably less than 10% of the average content of the panel surface.

Floor panels may warp in different humidity and the wear on the edges that generally warp upwards in dry conditions is much higher than on the inner part of the panel. Increase amounts of wear resistant particles may be applied at surface portions 2*a* adjacent to the panel edge.

Figure 2C:
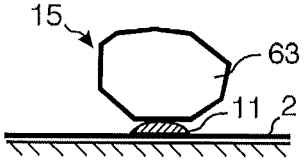
FIGS. 2*c-e* Illustrate bonding of wear resistant particles.
Figure 2D:
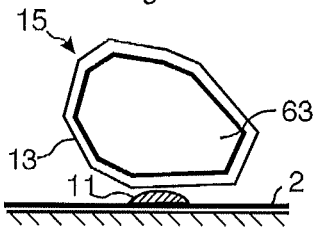
Figure 2E:
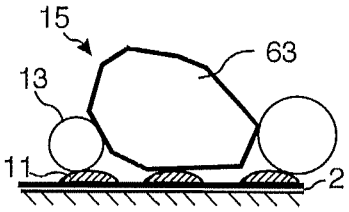

FIGS. 2*c*-2*e* shows how wear resistant particles, preferably aluminium oxide 63, may be bonded and position in well-defined patterns. A binder of blank ink 11 is applied on a surface with preferably a conventional digital ink head. The binder may also be applied with rollers and other similar methods. Water may be sufficient to bond the particles until they are pressed.

FIG. 2*c* shows that a binder is preferably included in the surface 2 and may react with the liquid pattern of blank ink 11 applied by the digital drop application head.

FIG. 2*d* shows that aluminium oxide particles 63, may be coated with a thermoplastic or thermosetting resin, for example, melamine 13.

FIG. 2*e* shows that dry overlay particles 15 may also be mixed with a spray dried binder in powder form such as melamine particles 13 that melt when they are in contact with the blank ink 11.

Figure 2F:
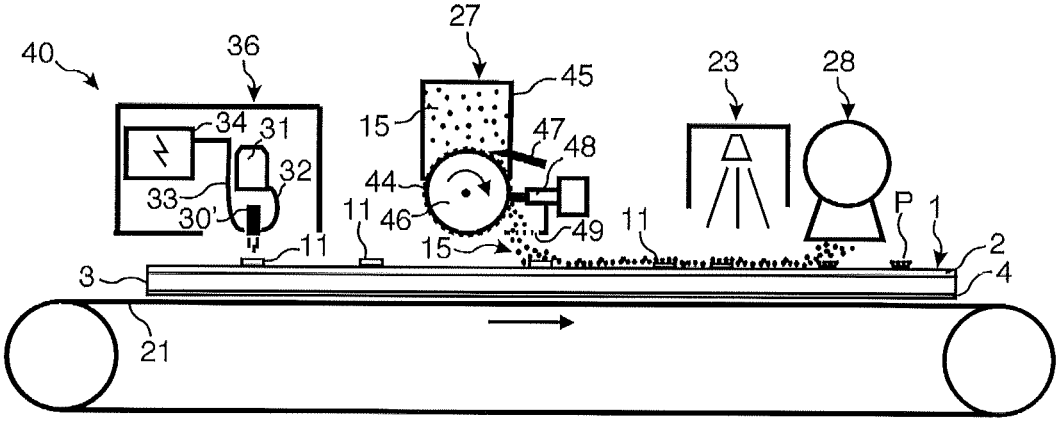
FIG. 2*f* Illustrate a method and equipment to apply wear resistant particles in pre-determined patterns.

FIG. 2*f* shows schematically a digital particle application equipment 40 that may be used to create a digital patter P of wear resistant particles on a panel 1 comprising a surface 2, a core 3 and a backing layer 4. A blank ink application station 36 comprising a digital drop application head 30', that preferably is a Piezo head or a thermal print head, applies a binder pattern with blank ink 11. Several heads 30' may be positioned side by side in order to cover the width of the surface that is printed. The binder pattern is created digitally in the same way as in conventional digital printing. The digital drop application head is connected with a feeding pipe 32 to a container 31 with blank ink. The digital drop application heads 30' are digitally connected with preferably data cables 33 or wireless to a digital control unit 34 that controls the application of the drops, the speed of the conveyor 21, the function of a dry ink application unit 27 and all other equipment that is used to bond and remove particles.

The water based drops of the blank ink 11, which in this embodiment serve as an application binder, should be wet until they pass the dry ink application unit 27 that in this preferred embodiment is a scattering station. Dry overlay 15, that in this preferred embodiment comprises aluminium oxide particles mixed with a resin of spray dried melamine powder, is scattered on the liquid blank ink 11.

The scattering equipment comprises a hopper 45 that contains dry overlay 15, a doctor blade 47 that together with a roller 46, preferably comprising an engraved, embossed, etched or sand blasted roller surface 44, acts as a dispensing device that moves a pre-determined amount of dry overlay 15 from the hopper 45 and to the surface 2. The roller 46 may also have a roller surface 44 that comprise small needles. A material-removing device that may be an oscillating or rotating brush 48 may also be used in some applications together with one or several rotating or oscillating meshes 49 that may oscillate or rotate in different directions.

The doctor blade 47 may be rigid or flexible and may have an edge that is adapted to the structure of the roller surface. The oscillating or rotating meshes 49 may also be formed such that they spread the dry overlay 15 in a pre-defined way and they may be combined with one of several nets that may be used to sieve the particles before they are applied as a layer. The rotation of the roller, the position of the doctor blade and the speed of the surface that is intended to be covered with the dry overlay may be used to control the layer thickness.

The liquid blank ink 11 and the dry overlay is in this embodiment heated and stabilized when it is displaced under preferably a hot IR lamp 23, which is located preferably after the digital drop application head 30' in the feeding direction.

A dry overlay removal station 28, that in this embodiment is based on air streams and vacuum, removes dry overlay particles that are not wet and not bonded by the binder pattern and a perfect dry overlay pattern P is provided. The dry overlay removal station may be located after the IR lights 23 or between the IR lights and the scattering unit 27. This production step may be repeated and several types of wear resistant particles may be applied at different portions of the surface. The removed particles may pass through a sieve or a filter and they may be recycled and reused again several times.

The dry overlay may in addition to wear resistant particles also comprise melamine particles and/or pigments and/or fibres, preferably bleached transparent or semi-transparent wood fibres.

The method to apply wear resistant particles in patterns in order to reach cost saving and increased transparency may also be used together with a conventional overlay paper or decorative paper. Wear resistant particles may be applied in patterns on the overlay prior or after impregnation and the overlay paper with the wear resistant particles applied in patterns may be applied on a decorative paper. Wear resistant particles may be applied in patterns on the decorative paper preferably after impregnation when the decorative paper is positioned on a carrier, preferably a sheet material such as HDF. Impregnation of the decorative paper may be avoided if the paper is applied on a layer comprising thermosetting resin, for example, a powder layer.

A transparent overlay paper without any wear resistant particles or with only small scratch resistant particles may be applied on the wear resistant pattern in order to provide additional properties such as different gloss levels or to provide a layer that protects the press plate against wear during pressing.

Powder based surfaces may be applied with a basic mix that does not include any aluminium oxide particles. Such wear resistant particles may be applied in patterns in a second step and surface portions without any wear resistant particles may be formed even in powder based surfaces in order to reduce tool wear.

All described embodiments may be partly or completely combined.

Example 1—Digitally Formed Powder Overlay

A HDF sheet with a thickens of 8 mm was sprayed with deionized water and a powder mix of about 200 g/m$^2$ of powder comprising wood fibres, melamine particles, brown colour pigments and aluminium particles was applied by scattering equipment on the HDF sheet. The water penetrated into the lower parts of the mix. The upper dry part of the mix was removed by vacuum and a very even powder mix of 150 gr/m$^2$ was obtained. The mix was cold pressed with a metal roller and a hard stabilized powder based surface with a brown basic colour was obtained. The panel with the stabilized powder surface was put on a conveyer and displaced under a digital Piezo print head that provided a conventional ink jet print on the brown base coloured surface. The digital print covered about 20% of the surface and the basic colour. A digital print head was thereafter used to applied drops of blank ink comprising mainly water on the digitally printed surface portions. A higher intensity of drops was applied on the printed portions that were intended to form upper parts of the surface than on the printed portions that were intended to form lower parts of the surface after the final pressing operation. A dry mix of aluminium particles (85% weight) with an average size of 100 microns and spray dried melamine formaldehyde particles (15% weight) with a similar size was scattered on the whole surface. The sheet was thereafter displaced under a vacuum-sucking pipe where essentially all non-bonded aluminium oxide particles and melamine formaldehyde particles were removed. A protective transparent wear resistant layer or a so-called overlay was formed with aluminium oxide particles applied on essentially only the digitally printed surface portions. The panel was thereafter pressed against an embossed press plate during 15 seconds under a temperature of 170° C. in a 40 bars press. The surface with the protective layer was cured to a hard wear resistant surface with a high quality wear resistant digital print comprising a higher amount of aluminium oxide particles in the upper parts of the printed and embossed surface portions than in the lower surface portions.

Example 2—Digitally Formed Paper Overlay

A digital Piezo print head was used to applied drops of blank ink comprising mainly water on a melamine impregnated overlay paper sheet. The drops were applied in a raster pattern with a drop distance of about 1 mm. A higher intensity of drops with a drop distance of 0.5 mm was applied on the surface portions that were intended to form upper parts of the surface. No drops were applied on a 12 mm wide surface portion that extended over the whole length of the overlay paper and that corresponded to the surface portion where a saw blade cuts the pressed sheet and where the locking system is formed. A dry mix of aluminium particles with an average size of 100 microns was scattered on the whole overlay paper surface. The overlay paper was thereafter displaced under a vacuum-sucking pipe where essentially all non-bonded aluminium oxide particles were removed. The bonded aluminium oxide particles formed a pattern, which was essentially identical to the applied drops. The overlay with the aluminium oxide particles was displaced under an IR lamp and applied on a HDF sheet with a decorative melamine impregnated paper. The sheet was thereafter pressed against an embossed press plate during 15 seconds under a temperature of 170° C. in a 40 bars press. The surface with the decorative and overlay papers was cured to a hard wear resistant surface with a high quality wear resistant overlay comprising a base structure with accurately positioned aluminium oxide particles with a pre-defined distances between the particles and with a higher amount of aluminium oxide particles in the upper parts of the printed and embossed surface portions than in the lower surface portions. The sheet was thereafter cut along the surface area without any aluminium oxide particles and the locking system was formed in edge portions, which were almost completely free from aluminium oxide particles. The wear on the saw blade and the milling tool was considerably lower.

Example 3—Digital Wear Layer on Decorative Paper

A digital Piezo print head was used to applied drops of blank ink comprising mainly water on a melamine impregnated decorative paper applied on a HDF core. The drops were applied in a raster pattern with a drop distance of about 0.6 mm on surface portions that were intended to form lower parts of the pressed surface. A higher intensity of drops with a drop distance of about 0.3 mm was applied on surface portions that were intended to form upper parts of the pressed surface. No drops were applied on a 12 mm wide surface portion that extended over the whole length of the decorative paper and that corresponded to the surface portion where a saw blade cuts the pressed sheet and where the locking system is formed. A dry mix of aluminium particles with an average size of 100 microns was scattered on the whole surface of the decorative paper. The sheet was thereafter displaced under a vacuum-sucking pipe where essentially all non-bonded aluminium oxide particles were removed. The bonded aluminium oxide particles formed a pattern, which was essentially identical to the applied drops. The sheet with the decorative paper and with the aluminium oxide particles was displaced under an IR lamp. A conventional melamine impregnated overlay without any aluminium oxide particles was applied over the decorative paper and the sheet with the two papers was thereafter pressed against an embossed press plate during 15 seconds under a temperature of 170° C. in a 40 bars pressure. The surface with the decorative and overlay papers was cured to a hard wear resistant surface with a high quality wear resistant surface comprising a base structure with accurately positioned aluminium oxide particles with a pre-defined distances between the particles and with a higher amount of aluminium oxide particles in the upper parts of the embossed surface portions than in the lower surface portions. The sheet was thereafter cut along the surface area without any aluminium oxide particles and a locking system was formed in edge portions, which were almost completely free from aluminium oxide particles. The wear on the saw blade and the milling tool was considerably lower.

EMBODIMENTS

1. A method of forming a wear resistant layer comprising transparent or semitransparent wear resistant particles (15) on a surface (2) wherein the method comprises the steps of:

applying a liquid binder (11) in a pattern (BP) on the surface (2), applying the wear resistant particles (15) on the surface (2), bonding a part of the wear resistant particles (15) to the surface (2) with the liquid binder (11), and removing non-bonded wear resistant particles (15) from the surface (2) such that the wear resistant layer is formed with evenly distributed wear resistant particles (15).

2. The method as in embodiment 1, wherein the wear resistant particles (15) are applied in a raster pattern with pre-determined distance (D1, D2) between the wear resistant particles (15).

3. The method as in embodiment 2, wherein the pre-determined distance (D1, D2) essentially corresponds to surface portions where the surface (2) is to be cut and/or where locking systems will be formed.

4. The method as in embodiments 1-3, wherein the surface (2) comprises a printed décor (P) and the wear resistant particles (15) are spaced from each other and coordinated in register with the printed décor (P).

5. The method as in embodiments 1-4, wherein the surface (2) is formed with embossed surface portions comprising upper (17*a*) and lower (17*b*) surface portions and wherein the content of wear resistant particles are higher in the upper portions (17*a*) than in the lower portions (17*b*).

6. The method as in any one of the preceding embodiments, wherein the wear resistant particles (15) comprise aluminium oxide (63) such as corundum.

7. The method as in any one of the preceding embodiments, wherein the wear resistant particles (15) are coated or mixed with a thermosetting resin.

8. The method as in any one of the preceding embodiments, wherein the surface (2) is a powder layer, a paper layer or a foil.

9. The method as in any one of the preceding embodiments, wherein the surface (2) is a part of a floor panel (1).

10. The method as in any one of the preceding embodiments, wherein the wear resistant particles (15) are removed by an airstream.

11. The method as in any one of the preceding embodiments, wherein the binder is a blank ink (11) comprising a liquid substance that is applied by a digital drop application head (30').

12. The method as in embodiment 11, wherein the liquid substance is water based.

13. The method as in embodiment 11 or 12, wherein the liquid substance is exposed to IR light (23) or hot air.

14. The method as in embodiment 11, wherein the liquid substance is applied with a Piezo ink head.

15. The method as in embodiment 11, wherein the liquid substance is applied with a thermo ink head.

16. The method as in any one of the preceding embodiments, wherein the surface (2) with the wear resistant particles (15) is heated and pressed.

17. The method as in any one of the preceding embodiments, wherein the wear resistant particles (15) are applied by scattering.

18. The method as in any one of the preceding embodiments, wherein the wear resistant particles (15) are arranged in a wood grain or a stone pattern.

19. A panel (1) with a decorative surface (2) comprising a pattern (P) of wear resistant particles (15) wherein the wear resistant particles (15) are applied in a raster pattern with pre-determined distance between the wear resistant particles (15).

20. The panel as in embodiment 19, wherein the surface (2) comprises a printed décor (P) and the wear resistant particles (15) are spaced from each other and coordinated with the printed décor (P).

21. The panel as in embodiment 19 or 20, wherein the surface (2) comprises a printed and embossed décor with an upper (17*a*) and a lower (17*b*) surface portion and wherein the content of wear resistant particles (15) are higher in the upper surface portion (17*a*) than in the lower surface portion (17*b*).

22. The panel as in embodiments 19-21, wherein an edge portion comprises a higher content of wear resistant particles than an inner surface portion spaced from the edge portion.

23. The panel as in any one of the preceding embodiments 19-22, wherein the surface (2) is a paper layer or a foil.

24. The panel as in any one of the preceding embodiments 19-22, wherein the surface (2) comprises a powder layer.

25. The panel as in any one of the preceding embodiments 19-24, wherein the surface (2) is a part of a building panel (1).

26. The panel as in any one of the preceding embodiments 19-25, wherein the surface (2) is a part of a floor panel (1).

27. The panel as in any one of the preceding embodiments 19-26, wherein the wear resistant particles (15) comprise aluminium oxide such as corundum.

28. The panel as in any one of the preceding embodiments 19-27, wherein the wear resistant particles (15) are arranged in a wood grain or a stone pattern.

29. The panel as in any one of the preceding embodiments 19-28, wherein the surface (2) is a part of a panel (1) that is a laminate or wood floor, a powder based floor, a tile or a LVT floor.

30. A sheet (1) with a decorative surface (2) comprising a pattern (P) of wear resistant particles (15) wherein the wear resistant particles (15) are applied in a raster pattern with pre-determined distance (D1, D2) between the wear resistant particles.

31. The sheet as in embodiment 30, wherein the pre-determined distance (D1, D2) essentially corresponds to surface portions where the sheet (1) is to be cut into several panels (1*a*, 1*b*) and/or where locking systems will be formed.

32. The sheet as in embodiments 30 or 31, wherein the surface (2) comprises a printed décor (P) and the wear resistant particles (15) are spaced from each other and coordinated in register with the printed décor (P).

33. The sheet as in embodiments 30-32, wherein the surface (2) comprises a printed and embossed décor with upper (17*a*) and lower (17*b*) surface portions and wherein the content of wear resistant particles (15) are higher in the upper portions (17*a*) than in the lower portions (17*b*).

34. The sheet as in any one of the preceding embodiments 30-33, wherein the wear resistant particles (15) comprise aluminium oxide (63) such as corundum.

35. A paper comprising a pattern (P) of wear resistant particles (15) wherein the wear resistant particles (15) are applied in a raster pattern with pre-determined distance between the wear resistant particles (15).

While illustrative embodiments of the invention have been described herein, the present invention is not limited to the various preferred embodiments described herein but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to the examples described in the present specification or during prosecution of the application, which examples are to be construed as non-exclusive.

The invention claimed is:

1. A method of forming a transparent or semi-transparent wear resistant layer comprising wear resistant particles on a surface wherein the method comprises the steps of:

applying a liquid binder in a pattern on the surface, wherein the surface is a powder layer, applying the wear resistant particles on the surface that has the liquid binder, bonding a part of the wear resistant particles to the surface with the liquid binder, removing non-bonded wear resistant particles from the surface such that the wear resistant layer is formed with evenly distributed wear resistant particles, and pressing the surface with the wear resistant layer under heat for curing the wear resistant layer.

2. The method as claimed in claim 1, wherein the wear resistant particles are applied in a raster pattern with predetermined distance between the wear resistant particles.

3. The method as claimed in claim 2, wherein the predetermined distance is between 5 and 10 mm.

4. The method as claimed in claim 1, wherein the surface comprises a printed décor and the wear resistant particles are spaced from each other and coordinated in register with the printed décor.

5. The method as claimed in claim 1, wherein the method further comprises embossing the surface with the wear resistant particles under heat and pressure for forming embossed surface portions comprising upper and lower surface portions and wherein the content of wear resistant particles are higher in the upper portions than in the lower portions.

6. The method as claimed in claim 1, wherein the wear resistant particles comprise aluminium oxide.

7. The method as claimed in claim 1, wherein the wear resistant particles are coated or mixed with a thermosetting resin.

8. The method as claimed in claim 7, wherein the pressing is with a continuous or discontinuous laminate press, where the resin cures under heat and pressure.

9. The method as claimed in claim 8, wherein the pressure is in the range of 40-60 bars.

10. The method as claimed in claim 1, wherein the surface is a part of a floor panel.

11. The method as claimed in claim 1, wherein the wear resistant particles are removed by an airstream.

12. The method as claimed in claim 1, wherein the binder is a blank ink comprising a liquid substance that is applied by a digital drop application head.

13. The method as claimed in claim 12, wherein the liquid substance comprises water.

14. The method as claimed in claim 12, wherein the liquid substance is exposed to IR light or heated.

15. The method as claimed in claim 12, wherein the liquid substance is applied with a Piezo ink head.

16. The method as claimed in claim 12, wherein the liquid substance is applied with a thermo ink head.

17. The method as claimed in claim 1, wherein the wear resistant particles are applied by scattering.

18. The method as claimed in claim 1, wherein the wear resistant particles are arranged in a wood grain or a stone pattern.

19. The method as claimed in claim 1, wherein the powder layer is provided on a substrate, and wherein the substrate with the powder layer and the wear resistant particles is pressed under heat.

20. The method as claimed in claim 1, wherein the powder layer is provided on a substrate, and wherein the powder layer is stabilized on the substrate prior to pressing under heat.

21. The method as claimed in claim 20, wherein the substrate is sprayed with an aqueous solution prior to providing the powder layer.

22. The method as claimed in claim 1, further comprising digitally printing on the surface to form a digitally printed surface portion, and applying the liquid binder on the digitally printed surface portion.

23. The method as claimed in claim 22, wherein the liquid binder is applied only on the digitally printed surface portion.

24. The method as claimed in claim 1, wherein an embossed press plate is used for the pressing.

25. A method of forming a panel comprising a transparent or semi-transparent wear resistant layer, wherein the method comprises the steps of:

applying a liquid binder in a pattern on a surface of a core, applying wear resistant particles on the surface in a raster pattern with a predetermined distance between the wear resistant particles, bonding a part of the wear resistant particles to the surface with the liquid binder, removing non-bonded wear resistant particles from the surface such that the wear resistant layer is formed with evenly distributed wear resistant particles, and cutting through the wear resistant layer, the surface, and the core along a cutting width to form the panel, wherein the cutting width is equal to the predetermined distance between the wear resistant particles.

26. The method as claimed in claim 25, wherein the predetermined distance is 5 to 10 mm.

* * * * *